US006290261B1

(12) United States Patent
Waggoner et al.

(10) Patent No.: US 6,290,261 B1
(45) Date of Patent: Sep. 18, 2001

(54) SHIPMENT FORM INCLUDING REUSABLE ADHESIVE

(75) Inventors: Bryce C. Waggoner, Monroe; David F. Laurash, Bellbrook; James J. DeLoughery, Miamisburg, all of OH (US); Nicholas N. Morton, Germantown, TN (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/354,504

(22) Filed: Jul. 15, 1999

Related U.S. Application Data

(60) Provisional application No. 60/093,151, filed on Jul. 17, 1998.

(51) Int. Cl.[7] ..... B42D 15/00

(52) U.S. Cl. ..... 283/62; 283/56; 283/67; 283/81; 283/101; 283/105; 283/107; 283/108; 281/2; 281/5; 281/38; 40/299

(58) Field of Search ..... 283/101, 105, 283/107, 108, 56, 62, 81, 67; 281/2, 5, 38; 40/299

(56) References Cited

U.S. PATENT DOCUMENTS

| | | | |
|---|---|---|---|
| 1,984,559 | 12/1934 | Wilcox | 229/74 |
| 2,305,426 | 12/1942 | Howell | 229/74 |
| 4,216,598 | 8/1980 | Newbert | 40/331 |
| 4,240,543 | 12/1980 | McKee | 206/39 |
| 4,460,119 | 7/1984 | Goodfellow et al. | 229/68 R |
| 4,462,538 | 7/1984 | Gendron | 229/68 R |
| 4,545,521 | 10/1985 | Hiersteiner | 229/68 R |
| 4,749,432 | 6/1988 | Ando et al. | 156/257 |
| 4,995,642 | 2/1991 | Juszak et al. | 283/105 |
| 5,042,843 | 8/1991 | Kuhns et al. | 283/109 |
| 5,282,649 | 2/1994 | Williams et al. | 283/56 |
| 5,284,689 | 2/1994 | Laurash et al. | 428/40 |
| 5,299,979 | 4/1994 | Ballard | 462/18 |
| 5,318,325 | 6/1994 | Ipsen | 283/81 |
| 5,324,153 | 6/1994 | Chess | 412/9 |
| 5,352,155 | 10/1994 | Fahey | 462/25 |
| 5,383,686 | 1/1995 | Laurash | 283/81 |
| 5,435,600 | 7/1995 | Griffiths et al. | 283/81 |
| 5,458,282 | 10/1995 | Martin | 229/92.8 |
| 5,482,753 * | 1/1996 | Langan et al. | 283/105 |
| 5,487,568 | 1/1996 | Ipsen | 283/81 |
| 5,547,227 | 8/1996 | Laurash et al. | 283/81 |
| 5,673,943 * | 10/1997 | Campbell | 283/101 |
| 5,807,623 | 9/1998 | Chess | 283/81 |
| 5,833,273 * | 11/1998 | Strenk et al. | 283/105 |
| 6,092,842 * | 7/2000 | Arway et al. | 283/81 |

* cited by examiner

*Primary Examiner*—Henry Tsai
*Assistant Examiner*—Mark T. Henderson
(74) *Attorney, Agent, or Firm*—Killworth, Gottman, Hagan & Schaeff, L.L.P.

(57) ABSTRACT

A shipment form is provided including a face sheet, a liner ply, a reusable adhesive laminate, and a laminating adhesive. The face sheet defines first and second major faces and includes printed indicia on the first major face. The printed indicia being arranged to indicate an attempted delivery. The reusable adhesive laminate includes a reusable adhesive and a removable ply. The reusable adhesive and the removable ply are configured such that the reusable adhesive retains its properties of adhesion following removal of the removable ply therefrom. The laminating adhesive is interposed between the liner ply and the face sheet so as to secure the liner ply to the second major face of the face sheet. The laminating adhesive is further interposed between the reusable adhesive laminate and the face sheet so as to secure the reusable adhesive laminate to the second major face of the face sheet.

38 Claims, 5 Drawing Sheets

SHIPMENT FORM INCLUDING REUSABLE ADHESIVE

CROSS-REFERENCE TO RELATED APPLICATIONS

This application claims the benefit of U.S. Provisional Application No. 60/093,151 filed Jul. 17,1998.

BACKGROUND OF THE INVENTION

The present invention relates to shipment forms and, more particularly, to a multifunction business form for indicating an attempted delivery and authorizing delivery or pick-up of a package.

Package delivery services are continuously confronted with the problems associated with undeliverable packages - packages which cannot be delivered because no one is available to accept delivery in general, the package must either be left at the delivery address or returned to the delivery station. In either case, there must be some documentation of the attempted delivery. Conventional attempted delivery notices typically comprise a form with some type of releasable or temporary adhesive provided thereon. The form describes the circumstances of the delivery and is adhered on a door, window, or other conspicuous surface at the delivery address. These conventional forms have inherent functional limitations and have achieved limited commercial success in the package delivery business. Accordingly, there is a need for an attempted delivery notice or shipment form that provides an improved means for indicating an attempted delivery and authorizing delivery or pick-up of a package.

BRIEF SUMMARY OF THE INVENTION

This need is met by the present invention wherein a shipment form including a reusable adhesive is provided. In accordance with one embodiment of the present invention, the shipment form comprises a face sheet, a liner ply, a reusable adhesive laminate, and a laminating adhesive. The face sheet defines first and second major faces and includes printed indicia on the first major face. The printed indicia being arranged to indicate an attempted delivery.

The reusable adhesive laminate includes a reusable adhesive and a removable ply. The reusable adhesive and the removable ply are configured such that the reusable adhesive retains its properties of adhesion following removal of the removable ply therefrom. The laminating adhesive is interposed between the liner ply and the face sheet so as to secure the liner ply to the second major face of the face sheet. The laminating adhesive is further interposed between the reusable adhesive laminate and the face sheet so as to secure the reusable adhesive laminate to the second major face of the face sheet. The removable ply may include a release material incorporated therein.

The reusable adhesive laminate preferably further comprises a paper ply interposed between the laminating adhesive and the reusable adhesive. The reusable adhesive is preferably arranged to define an adhesion surface that is capable of supporting the weight of the shipment form when secured to a substantially vertical mounting surface. The laminating adhesive may comprise first and second laminating adhesive portions, the first laminating adhesive portion being interposed between the liner ply and the face sheet and the second laminating adhesive portion being interposed between the reusable adhesive laminate and the face sheet. The first and second adhesive portions are preferably separated by an adhesive void.

The face sheet may further define a peel-out signature label portion and the shipment form may further comprise a peel-out release layer interposed between the peel-out signature label portion and the liner ply. A portion of the laminating adhesive may be interposed between the peel-out signature label portion and the peel-out release layer. The peel-out signature label portion, the laminating adhesive, and the peel-out release layer may be configured such that the laminating adhesive retains its properties of adhesion and remains adhered to the peel-out signature label following removal of the peel-out signature label from the shipment form.

The face sheet and the reusable adhesive laminate may include respective cutout portions formed therein to define a form hanging aperture. A die cut may be provided to extend entirely through the cross section of the form from a side edge of the form to the form hanging aperture. The shipment form may define a top edge and a bottom edge and the face sheet may extend from the top edge to the bottom edge.

In accordance with another embodiment of the present invention, a shipment form is provided comprising a face sheet, a liner ply, a laminating adhesive, and a reusable adhesive. The face sheet defines first and second major faces and includes printed indicia on the first major face, the printed indicia being arranged to indicate an attempted delivery. The liner ply includes a die cut defining a boundary between a laminated liner ply portion and a removable liner ply portion. The laminating adhesive is interposed between the liner ply and the face sheet so as to secure the laminated liner ply portion to the second major face of the face sheet. The reusable adhesive is interposed between the liner ply and the face sheet so as to secure the removable liner ply portion to the second major face of the face sheet. The reusable adhesive and the removable liner ply portion are configured such that the reusable adhesive retains its properties of adhesion following removal of the removable liner ply portion therefrom.

Preferably, the removable liner ply portion includes a release layer adjacent the reusable adhesive and the die cut extends through the liner ply. The die cut may be arranged to define a linear succession of perforations across the liner ply. Further, the face sheet and the liner ply preferably extend from the top edge of the form to the bottom edge of the form.

In accordance with yet another embodiment of the present invention, a shipment form is provided comprising a face sheet, a liner ply, a reusable adhesive laminate, and a laminating adhesive. The face sheet defines first and second major faces and includes printed indicia on the first major face. The printed indicia is arranged to indicate an attempted delivery. The liner ply includes a die cut defining a boundary between a laminated liner ply portion and a removable liner ply portion. The reusable adhesive laminate includes a reusable adhesive and a removable ply wherein the reusable adhesive and the removable ply are configured such that the reusable adhesive retains its properties of adhesion following removal of the removable ply therefrom. The laminating adhesive is interposed between-the laminated liner ply portion of the liner ply and the face sheet so as to secure the laminated liner ply portion to the second major face of the face sheet. The laminating adhesive is further interposed between the reusable adhesive laminate and the liner ply so as to secure the reusable adhesive laminate to the laminated liner ply portion and the removable liner ply portion. The die cut extends through the laminating adhesive and the removable ply of the reusable adhesive laminate.

The reusable adhesive laminate may further includes a complementary face sheet secured to the laminated liner ply portion via the reusable adhesive and the laminating adhesive. The removable ply preferably includes a release material incorporated therein. The laminating adhesive may comprise first and second laminating adhesive portions separated by an adhesive void. The first laminating adhesive portion being interposed between the liner ply and the face sheet and the second laminating adhesive portion being interposed between the liner ply and the reusable adhesive laminate. The shipment form may define a top edge and a bottom edge and the liner ply may extend from the top edge to the bottom edge.

In accordance with yet another embodiment of the present invention, a shipment form is provided comprising a face sheet, a liner ply, a reusable adhesive laminate, and a laminating adhesive. The face sheet defines first and second major faces and includes printed indicia on the first major face arranged to indicate an attempted delivery. The liner ply includes a die cut defining a boundary between a laminated liner ply portion and a removable liner ply portion. The laminating adhesive is interposed between the liner ply and the face sheet so as to secure the laminated liner ply portion to the second major face of the face sheet. The reusable adhesive is interposed between the laminated liner ply portion and a complementary face sheet and between the removable liner ply portion and the complementary face sheet so as to secure the removable liner ply portion and the laminated liner ply portion to the complementary face sheet. The reusable adhesive and the removable liner ply portion are configured such that the reusable adhesive retains its properties of adhesion following removal of the removable liner ply portion therefrom. The removable liner ply portion may include a release layer adjacent the reusable adhesive.

Accordingly, it is an object of the present invention to provide a shipment form incorporating a reusable adhesive portion arranged to enable convenient and cost efficient posting of an attempted delivery. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
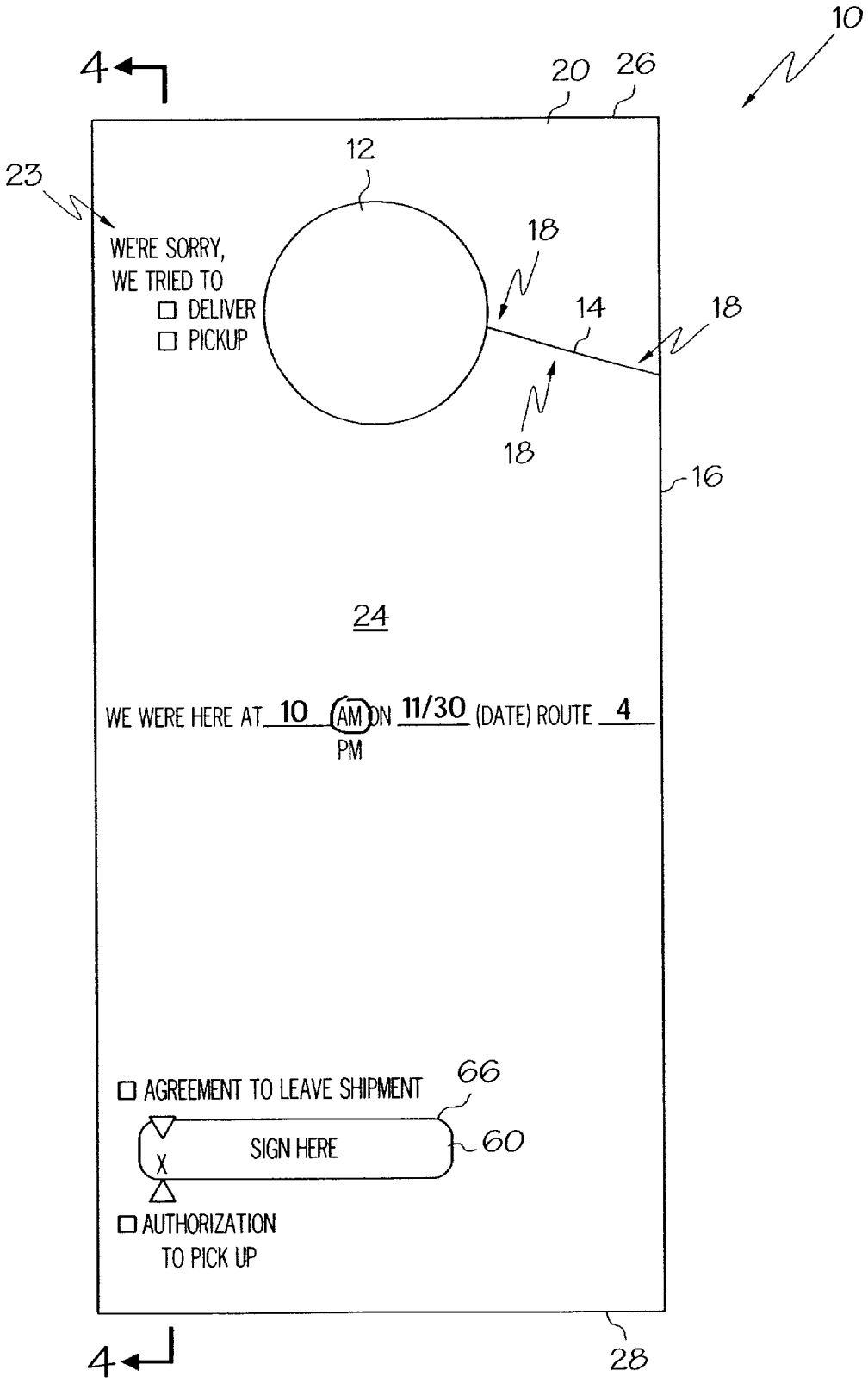
FIG. 1 is a front view of a shipment form according to the present invention.
Figure 2:
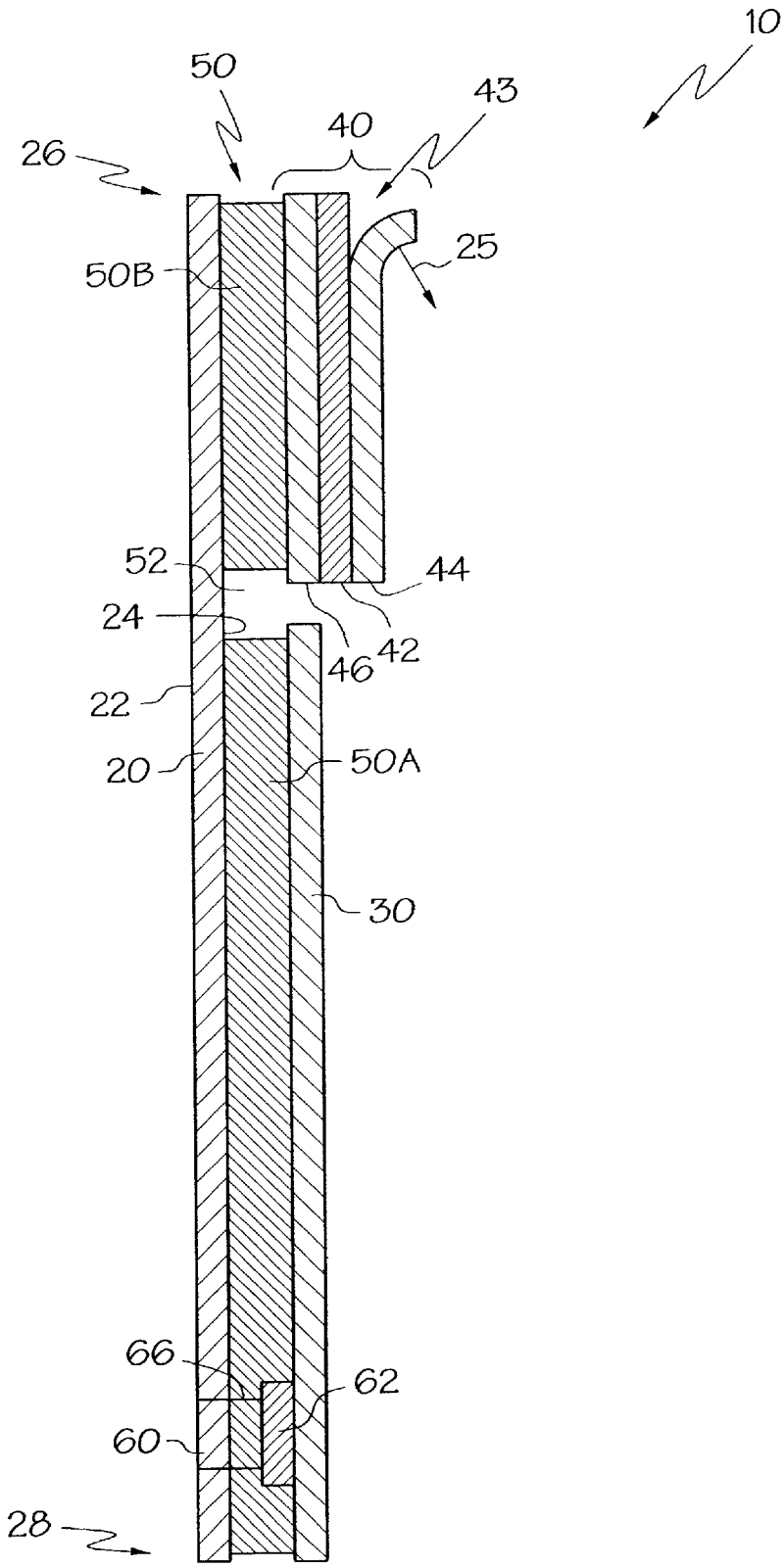
FIG. 2 is a schematic cross-sectional illustration of a shipment form according to one embodiment of the present invention.

Referring initially to FIGS. 1 and 2, a shipment form 10 according to one embodiment of the present invention is illustrated. The shipment form 10 comprises a face sheet 20, a liner ply 30, a reusable adhesive laminate 40, and a laminating adhesive 50. The face sheet 20 defines first and second major faces 22, 24, the first of which includes printed indicia 23 arranged to indicate an attempted delivery, e.g., "We're Sorry, We Tried to Deliver a Shipment of . . . " As will be appreciated by those practicing the present invention, a variety of additional or different messages may be conveyed by the printed indicia 23 for the purposes of indicating an attempted delivery, describing the nature of the attempted delivery, describing the conditions for delivery, etc. As will be further appreciated by those practicing the present invention, printed indicia may additionally or alternatively be presented on the exterior surface of the liner ply 30.

As is described in further detail herein, the face sheet 20 also includes a form hanging aperture 12 and a peel-out signature label 60. The shipment form 10 defines a top edge 26 and a bottom edge 28 and the face sheet 20 extends from the top edge 26 to the bottom edge 28. Referring specifically to FIG. 2, the reusable adhesive laminate 40 includes a reusable adhesive 42, e.g., a pressure sensitive adhesive, and a removable ply 44. The reusable adhesive 42 and the removable ply 44 are configured such that the reusable adhesive 42 retains its properties of adhesion following removal of the removable ply 44 therefrom. The removable ply 44 is most conveniently removed in the manner indicated by the directional arrow 25. In this manner, the reusable adhesive 42 may be employed to secure the shipment form 10 to a mounting surface, e.g., a door or window, upon removal of the removable ply 44.

The laminating adhesive 50 is interposed between the liner ply 30 and the face sheet 20 so as to secure the liner ply 30 to the second major face 24 of the face sheet 20. The laminating adhesive 50 is also interposed between the reusable adhesive laminate 40 and the face sheet 20 so as to secure the reusable adhesive laminate 40 to the second major face 24 of the face sheet 20. A paper ply 46 is interposed between the laminating adhesive 50 and the reusable adhesive 42. As will be appreciated by those practicing the present invention, a variety of laminating adhesives may be utilized in the various embodiments of the present invention. Specific examples of suitable laminating adhesives include adhesive 2107, available from H. B. Fuller, St. Paul, Minn., Fasson S-246 adhesive, available from Avery Dennison, Fasson Roll NA, Painesville, Ohio, and adhesive P-504 available from Green Bay Packaging, Green Bay, Wis.

The removable ply 44 includes a release material incorporated therein so as to be readily removable from the reusable adhesive 42 and so as to preserve the adhesive properties of the reusable adhesive 42. It is important to note that the reusable adhesive 42 should be arranged to define an adhesion surface that is capable of supporting the weight of the shipment form 10 when secured to a substantially vertical mounting surface such as a window or door. The reusable adhesive 42, removable ply 44, and paper ply 46 may be conveniently included in the construction of the shipment form 10 because conventional commercially available adhesive laminates typically include these three layers. An adhesive laminate suitable for use in the various embodiments of the present invention may be obtained from Green Bay Packaging, Green Bay, Wis., and comprises 50# EDP, R-534 adhesive, and 50# liner.

As is illustrated in FIG. 2, the laminating adhesive 50 comprises first and second laminating adhesive portions 50A, 50B. The first laminating adhesive portion 50A is interposed between the liner ply 30 and the face sheet 20 to permanently secure the liner ply 30 to the face sheet 20. The second laminating adhesive portion 50B is interposed between the reusable adhesive laminate 40 and the face sheet 20 to secure the reusable adhesive laminate 40 to the face sheet 20. Of course, as is noted above, the removable ply 44 of the reusable adhesive laminate 40 may be removed from the shipment form 10. The first and second adhesive portions 50A and 50B are preferably separated by an adhesive void 52.

As is clearly illustrated in FIG. 2, the reusable adhesive 42 defines an exposed adhesive surface 43 following removal of the removable ply 44.

A portion of the face sheet 20 is dedicated to the peel-out signature label portion 60 noted above. A peel-out release layer 62 is interposed between the liner ply 30 and the laminating adhesive 50 beneath the peel-out signature label portion 60. A die cut, 66 through the face sheet 20 and the laminating adhesive defines the periphery of the peel-out signature label portion 60 and enables removal of the peel-out label portion 60. The peel-out label portion 60, the laminating adhesive 50, and the peel-out release layer 62 are configured such that the laminating adhesive 50 retains its properties of adhesion and remains adhered to the peel-out signature label portion 60 following removal of the peel-out signature label portion 60 from the shipment form 10. In this manner, the peel-out signature label portion 60 may be removed from the shipment form 10 and secured to a delivery table or work sheet. It is contemplated by the present invention that the peel-out signature label portion 60, the peel-out release layer 62, and the die cut 66 may be arranged such that the peel-out signature label portion 60 may be removed from the liner ply side of the shipment form 10.

The face sheet 20, the second laminating adhesive portion 50B of the laminating adhesive 50, and the reusable adhesive laminate 40 include respective cut-out portions formed therein to define the form hanging aperture 12. Further, a die cut 14 extends entirely through the cross section of the form 10 from a side edge 16 of the form 10 to the form hanging aperture 12. The die cut 14 and the form hanging aperture 12 are arranged to enable a user to hang the form 10 from a conventional door knob or other projection. Preferably, the die cut 14 includes breakable ties 18 defined by the material of the face sheet 20 to temporarily secure the face sheet 20 in a substantially planar orientation in the vicinity of the die cut 14. The ties 18 are broken by a user of the form 10 when the form 10 is to be hung on a door knob or other similar projection.

Figure 3:
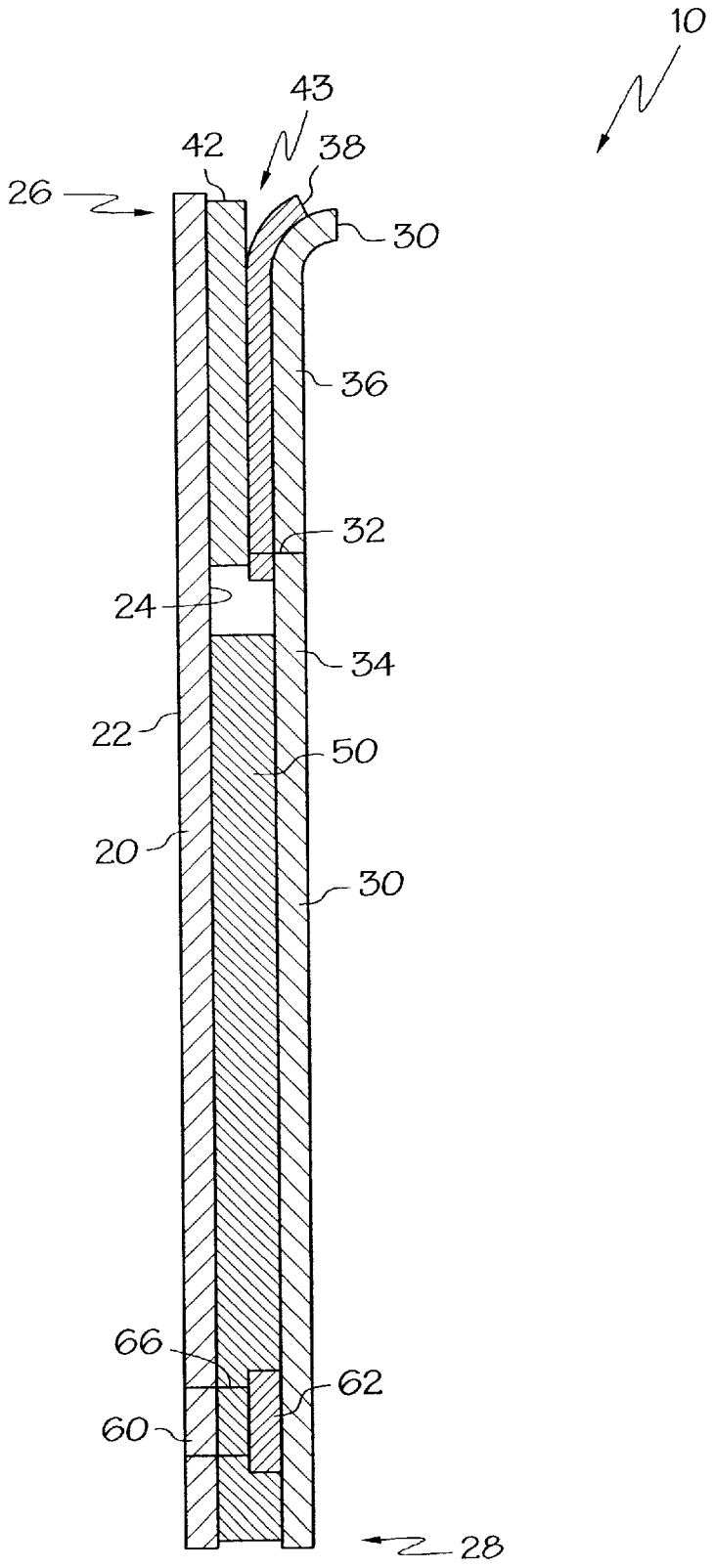
FIGS. 3–5 are additional schematic cross-sectional illustrations of shipment forms according to further embodiments of the present invention.

Referring now to the alternative embodiment of the present invention illustrated in FIG. 3, the shipment form 10 includes the face sheet 20, the liner ply 30, the laminating adhesive 50, and the reusable adhesive 42. The liner ply 30 includes a die cut 32 defining a boundary between a laminated liner ply portion 34 and a removable liner ply portion 36. The laminating adhesive 50 is interposed between the liner ply 30 and the face sheet 20 so as to secure the laminated liner ply portion 34 to the second major face 24 of the face sheet 20. The reusable adhesive 42 is interposed between the liner ply 30 and the face sheet 20 so as to secure the removable liner ply portion 36 to the second major face 24 of the face sheet 20. The reusable adhesive 42 and the removable liner ply portion 36 are configured such that the reusable adhesive 42 retains its properties of adhesion following removal of the removable liner ply portion 36 therefrom. For example, the removable liner ply portion 36 may include a release layer 38 adjacent the reusable adhesive 42. In this manner, the shipment form may be secured to a surface by removing the removable liner ply portion 36 and exposing the reusable adhesive 42 to the surface. As will be appreciated by those practicing the present invention, a variety of reusable adhesives may be utilized in the various embodiments of the present invention. Specific examples of suitable reusable adhesives include Instant-Lok, available from National Starch and Chemical, Bridgewater, N.J., Fasson R-195 and R-130 adhesive, available from Avery Dennison, Fasson Roll NA, Painesville, Ohio, and Brown Bridge B-122 adhesive, available from Spinnaker Coating, Troy, Ohio. As will be appreciated by those practicing the present invention, the recited adhesive have varying adhesive strengths and other functional characteristics that may be taken into account in practicing the present invention.

In the embodiment illustrated in FIG. 3, the die cut 32 extends through the liner ply 30 and defines a portion along which the removable liner ply portion 36 may be separated from the laminated liner ply portion 34. However, it is contemplated by the present invention that the die cut 32 may comprise any structure arranged to permit convenient separation of the removable liner ply portion 36 from the laminated liner ply portion 34. For example, the die cut 32 may be arranged to define a linear succession of perforations across the liner ply 30. Finally, it is noted that in the FIG. 3 embodiment, the face sheet 20 and the liner ply 30 extend from the top edge 26 of the form 10 to the bottom edge 28 of the form 10.

As is clearly illustrated in FIG. 3, the reusable adhesive 42 defines an exposed adhesive surface 43 following removal of the removable liner ply portion 36.

Figure 4:
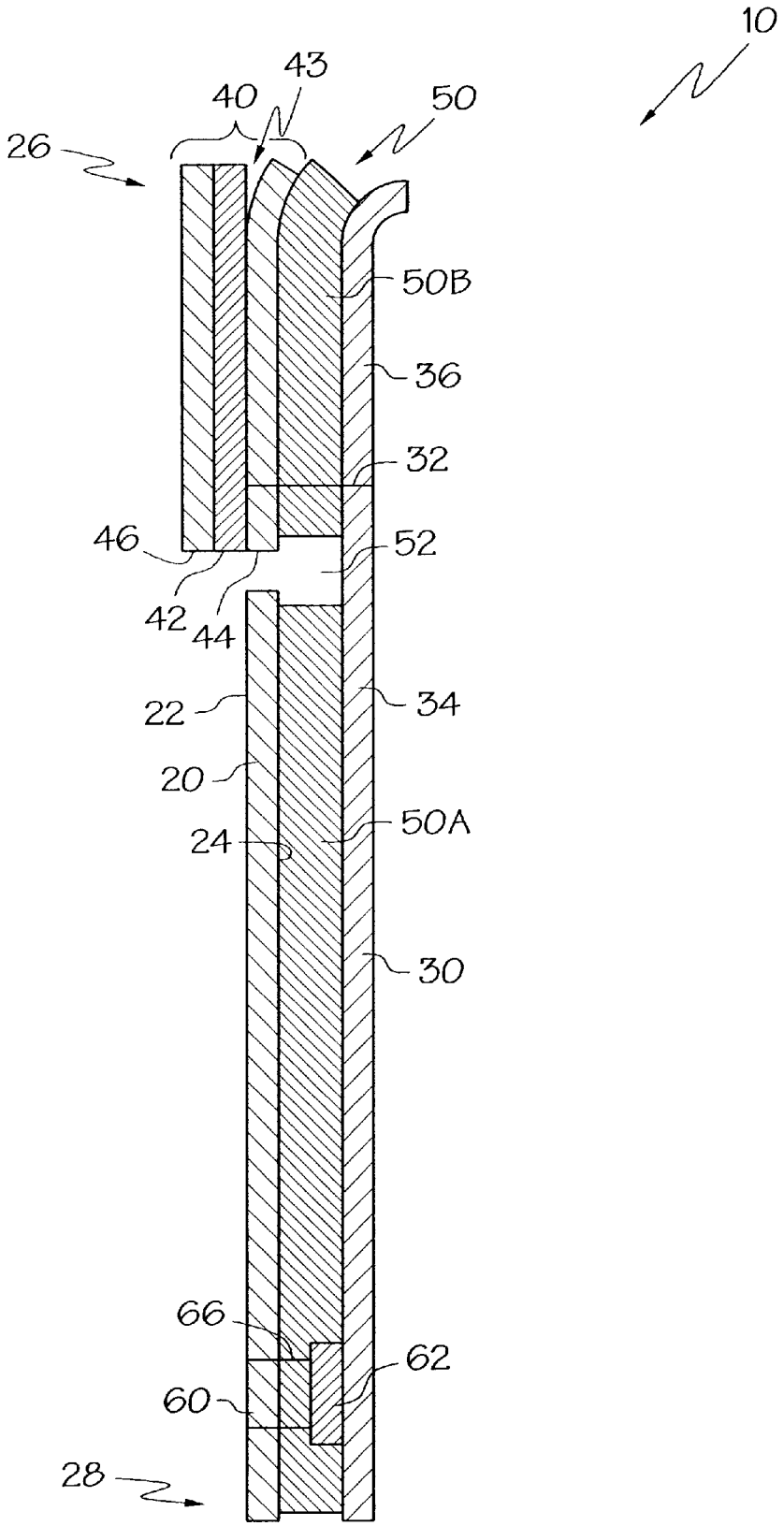

Referring now to the alternative embodiment of the present invention illustrated in FIG. 4, the shipment form 10 includes the face sheet 20, the liner ply 30, the laminating adhesive 50, and the reusable adhesive laminate 40. The liner ply 30 includes the die cut 32 defining the boundary between a laminated liner ply portion 34 and a removable liner ply portion 36. The reusable adhesive laminate 40 includes the reusable adhesive 42 and a removable ply 44. The reusable adhesive laminate 40 further includes a complementary face sheet or paper ply 46 secured to the laminated liner ply portion 34 via the reusable adhesive 42 and the second laminating adhesive portion 50B of the laminating adhesive 50.

The reusable adhesive 42 and the removable ply 44, which preferably includes a release material incorporated therein, are configured such that the reusable adhesive 42 retains its properties of adhesion following removal of the removable ply 44 therefrom. The laminating adhesive 50 is interposed between the laminated liner ply portion 34 and the face sheet 20 so as to secure the laminated liner ply portion 34 to the second major face 24 of the face sheet 20. The laminating adhesive 50 is further interposed between the reusable adhesive laminate 40 and the liner ply 30 so as to secure the reusable adhesive laminate 40 to the laminated liner ply portion 34 and the removable liner ply portion 36. Specifically, the laminating adhesive 50 comprises the first and second laminating adhesive portions 50A, 50B separated by the adhesive void 52. The first laminating adhesive portion 50A is interposed between the liner ply 30 and the face sheet 20 and the second laminating adhesive portion 50B is interposed between the liner ply 30 and the reusable adhesive laminate 40.

As is clearly illustrated in FIG. 4, the reusable adhesive 42 defines an exposed adhesive surface 43 following removal of the removable liner ply portion 36.

The die cut 32 extends through the liner ply 30, the laminating adhesive 50, and the removable ply 44. In this manner, the shipment form 10 may be secured to a surface by peeling back and removing the removable ply 44, a portion of the laminating adhesive 50, and the removable liner ply portion 36 and exposing the reusable adhesive 42 to the surface. It is noted that the remainder of the reusable adhesive laminate 40 remains adhered to the liner ply 30 via the laminating adhesive 50. In the FIG. 4 embodiment, the liner ply 30 extends from the top edge 26 of the form 10 to the bottom edge 28 of the form.

Figure 5:
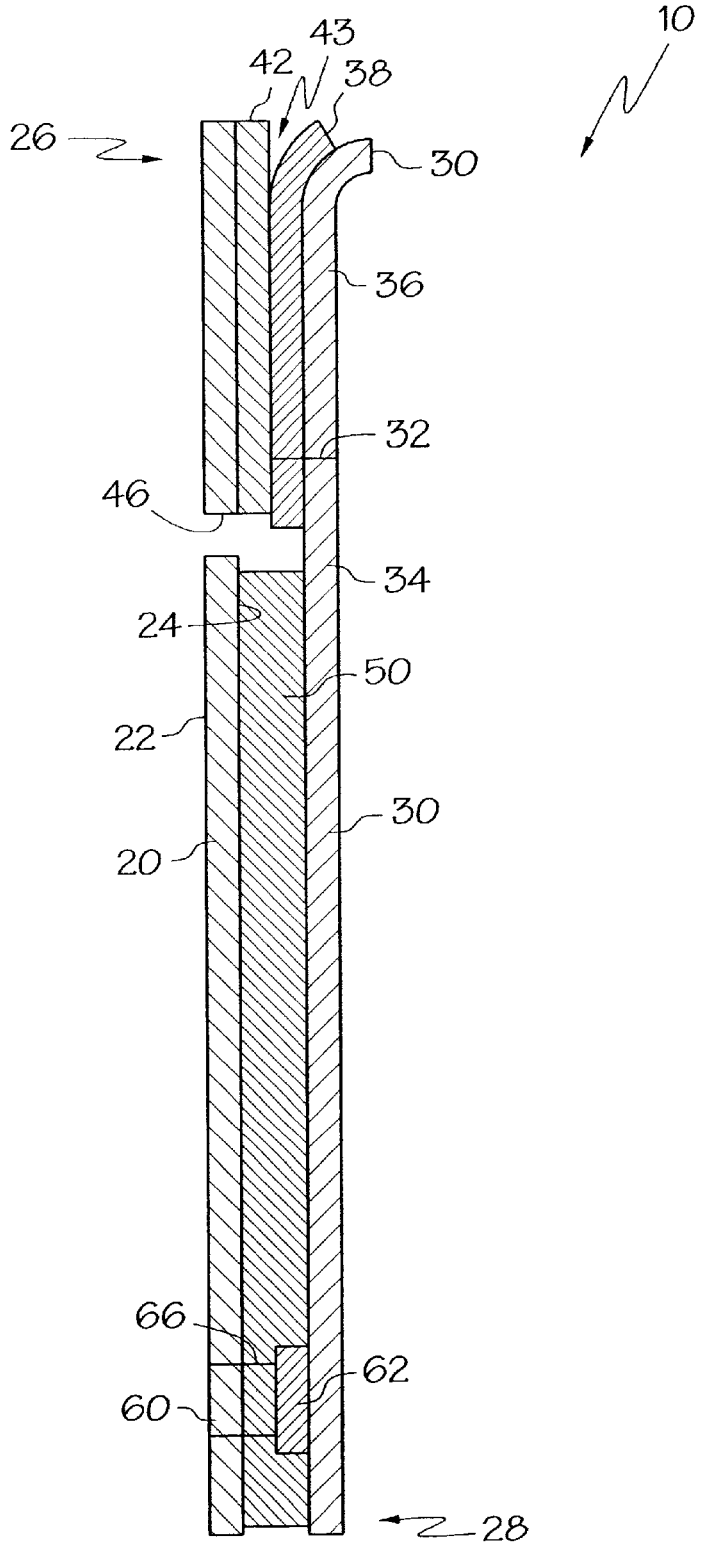

Referring finally to the alternative embodiment of the present invention illustrated in FIG. 5, the shipment form 10 includes the face sheet 20, the liner ply 30, the laminating adhesive 50, the reusable adhesive 42, and release layer 38 adjacent the reusable adhesive 42. The liner ply 30 includes the die cut 32 defining the boundary between the laminated liner ply portion 34 and the removable liner ply portion 36. The laminating adhesive 50 is interposed between the liner ply 30 and the face sheet 20 so as to secure the laminated liner ply portion 34 to the second major face 24 of the face sheet 20. In the FIG. 5 embodiment, the liner ply 30 extends from the top edge 26 of the form 10 to the bottom edge 28 of the form.

The reusable adhesive 42 is interposed between the laminated liner ply portion 34 and the complementary face sheet or paper ply 46 and between the removable liner ply portion 36 and the complementary face sheet 46. Of course, the reusable adhesive 42 and the removable liner ply portion 36 are configured such that the reusable adhesive 42 retains its properties of adhesion following removal of the removable liner ply portion 36 therefrom.

As is clearly illustrated in FIG. 5, the reusable adhesive 42 defines an exposed adhesive surface 43 following removal of the removable liner ply portion 36.

Having described the invention in detail and by reference to preferred embodiments thereof, it will be apparent that modifications and variations are possible without departing from the scope of the invention defined in the appended claims.

What is claimed is:

1. A shipment form comprising:

a face sheet defining first and second major faces and including printed indicia on said first major face, said printed indicia being arranged to indicate an attempted delivery;

a liner ply;

a laminating adhesive interposed between said liner ply and face sheet so as to secure said liner ply to said second major face of said face sheet;

a reusable adhesive laminate including a reusable adhesive and a removable ply wherein said laminating adhesive is interposed between said reusable adhesive laminate and said face sheet so as to secure said reusable adhesive laminate to said second major face of said face sheet, said reusable adhesive and said removable ply are configured such that said reusable adhesive remains secured to said face sheet and retains its properties of adhesion following removal of said removable ply from a remainder of said shipment form, and said reusable adhesive defines an exposed adhesive surface on the remainder of said shipment form following removal of said removable ply from the remainder of said shipment form.

2. A shipment form as claimed in claim 1 wherein said reusable adhesive laminate further comprises a paper ply interposed between said laminating adhesive and said reusable adhesive.

3. A shipment form as claimed in claim 1 wherein said removable ply includes a release material incorporated therein.

4. A shipment form as claimed in claim 1 wherein said reusable adhesive is arranged to define an adhesion surface that is capable of supporting the weight of said shipment form when secured to a substantially vertical mounting surface.

5. A shipment form as claimed in claim 1 wherein said laminating adhesive comprises first and second laminating adhesive portions, wherein said first laminating adhesive portion is interposed between said liner ply and said face sheet and said second laminating adhesive portion is interposed between said reusable adhesive laminate and said face sheet.

6. A shipment form as claimed in claim 1 wherein said face sheet further defines a peel-out signature label portion, wherein said shipment form further comprises a peel-out release layer interposed between said peel-out signature label portion and said liner ply, wherein a portion of said laminating adhesive is interposed between said peel-out signature label portion and said peel-out release layer, and wherein said peel-out signature label portion, said laminating adhesive, and said peel-out release layer are configured such that said laminating adhesive retains its properties of adhesion and remains adhered to said peel-out signature label following removal of said peel-out signature label from said shipment form.

7. A shipment form as claimed in claim 1 wherein said face sheet and said reusable adhesive laminate include respective cut-out portions formed therein to define a form hanging aperture.

8. A shipment form as claimed in claim 1 wherein said shipment form defines a top edge and a bottom edge and wherein said face sheet extends from said top edge to said bottom edge.

9. A shipment form as claimed in claim 5 wherein said first and second adhesive portions are separated by an adhesive void.

10. A shipment form as claimed in claim 7 further comprising a die cut extending entirely through a cross section of said form from a side edge of said form to said form hanging aperture.

11. A shipment form comprising:

a face sheet defining first and second major faces and including printed indicia on said first major face, said printed indicia being arranged to indicate an attempted delivery;

a liner ply including a die cut defining a boundary between a laminated liner ply portion and a removable liner ply portion;

a laminating adhesive interposed between said liner ply and said face sheet so as to secure said laminated liner ply portion to said second major face of said face sheet; and a reusable adhesive interposed between said liner ply and said face sheet so as to secure said removable liner ply portion to said second major face of said face sheet, wherein said reusable adhesive and said removable liner ply portion are configured such that said reusable adhesive remains secured to said face sheet and retains its properties of adhesion following removal of said removable liner ply portion from a remainder of said shipment form, and said reusable adhesive defines an exposed adhesive surface on the remainder of said shipment form following removal of said removable ply from the remainder of said shipment form.

12. A shipment form as claimed in claim 11 wherein said removable liner ply portion includes a release layer adjacent said reusable adhesive.

13. A shipment form as claimed in claim 11 wherein said die cut extends through said liner ply.

14. A shipment form as claimed in claim 11 wherein said die cut is arranged to define a linear succession of perforations across said liner ply.

15. A shipment form as claimed in claim 11 wherein said reusable adhesive is arranged to define an adhesion surface that is capable of supporting a weight of said shipment form when secured to a substantially vertical mounting surface.

16. A shipment form as claimed in claim 11 wherein said face sheet further defines a peel-out signature label portion, wherein said shipment form further comprises a peel-out release layer interposed between said peel-out signature label portion and said liner ply, wherein a portion of said laminating adhesive is interposed between said peel-out signature label portion and said peel-out release layer, and wherein said peel-out signature label portion, said laminating adhesive, and said peel-out release layer are configured such that said laminating adhesive retains its properties of adhesion and remains adhered to said peel-out signature label following removal of said peel-out signature label from said shipment form.

17. A shipment form as claimed in claim 11 wherein said face sheet, said liner ply, and said reusable adhesive include respective cut-out portions formed therein to define a form hanging aperture.

18. A shipment form as claimed in claim 11 wherein said shipment form defines a top edge and a bottom edge and wherein said face sheet and said liner ply extend from said top edge to said bottom edge.

19. A shipment form as claimed in claim 17 further comprising a die cut extending entirely through a cross section of said form from a side edge of said form to said form hanging aperture.

20. A shipment form comprising:

a face sheet defining first and second major faces and including printed indicia on said first major face, said printed indicia being arranged to indicate an attempted delivery;

a liner ply including a die cut defining a boundary between a laminated liner ply portion and a removable liner ply portion;

a reusable adhesive laminate including a reusable adhesive and a removable ply wherein said reusable adhesive and said removable ply are configured such that said reusable adhesive retains its properties of adhesion following removal of said removable ply therefrom; and a laminating adhesive interposed between said laminated liner ply portion of said liner ply and said face sheet so as to secure said laminated liner ply portion to said second major face of said face sheet, said laminating adhesive being further interposed between said reusable adhesive laminate and said liner ply so as to secure said reusable adhesive laminate to said laminated liner ply portion and said removable liner ply portion, wherein said die cut extends through said laminating adhesive and said removable ply of said reusable adhesive laminate.

21. A shipment form as claimed in claim 20 wherein said reusable adhesive laminate further includes a complementary face sheet secured to said laminated liner ply portion via said reusable adhesive and said laminating adhesive.

22. A shipment form as claimed in claim 20 wherein said removable ply includes a release material incorporated therein.

23. A shipment form as claimed in claim 20 wherein said reusable adhesive is arranged to define an adhesion surface that is capable of supporting a weight of said shipment form when secured to a substantially vertical mounting surface.

24. A shipment form as claimed in claim 20 wherein said laminating adhesive comprises first and second laminating adhesive portions, wherein said first laminating adhesive portion is interposed between said liner ply and said face sheet and said second laminating adhesive portion is interposed between said liner ply and said reusable adhesive laminate.

25. A shipment form as claimed in claim 20 wherein said face sheet further defines a peel-out signature label portion, wherein said shipment form further comprises a peel-out release layer interposed between said peel-out signature label portion and said liner ply, wherein a portion of said laminating adhesive is interposed between said peel-out signature label portion and said peel-out release layer, and wherein said peel-out signature label portion, said laminating adhesive, and said peel-out release layer are configured such that said laminating adhesive retains its properties of adhesion and remains adhered to said peel-out signature label following removal of said peel-out signature label from said shipment form.

26. A shipment form as claimed in claim 20 wherein said liner ply, said reusable adhesive laminate, and said laminating adhesive include respective cut-out portions formed therein to define a form hanging aperture.

27. A shipment form as claimed in claim 20 wherein said shipment form defines a top edge and a bottom edge and wherein said liner ply extends from said top edge to said bottom edge.

28. A shipment form as claimed in claim 24 wherein said first and second adhesive portions are separated by an adhesive void.

29. A shipment form as claimed in claim 26 further comprising a die cut extending entirely through a cross section of said form from a side edge of said form to said form hanging aperture.

30. A shipment form comprising:

a face sheet defining first and second major faces and including printed indicia on said first major face, said printed indicia being arranged to indicate an attempted delivery;

a liner ply including a die cut defining a boundary between a laminated liner ply portion and a removable liner ply portion;

a laminating adhesive interposed between said liner ply and said face sheet so as to secure said laminated liner ply portion to said second major face of said face sheet; and a reusable adhesive interposed between said laminated liner ply portion and a complementary face sheet and between said removable liner ply portion and said complementary face sheet so as to secure said removable liner ply portion and said laminated liner ply portion to said complementary face sheet, wherein said reusable adhesive and said removable liner ply portion are configured such that said reusable adhesive remain secured to said complementary face sheet and retains its properties of adhesion following removal of said removable liner ply portion from a remainder of said shipment form, and said reusable adhesive defines an exposed adhesive surface on the remainder of said shipment form following removal of said removable ply from the remainder of said shipment form.

31. A shipment form as claimed in claim 30 wherein said removable liner ply portion includes a release layer adjacent said reusable adhesive.

32. A shipment form as claimed in claim 30 wherein said die cut extends through said liner ply.

33. A shipment form as claimed in claim 30 wherein said die cut is arranged to define a linear succession of perforations across said liner ply.

34. A shipment form as claimed in claim 30 wherein said reusable adhesive is arranged to define an adhesion surface that is capable of supporting a weight of said shipment form when secured to a substantially vertical mounting surface.

35. A shipment form as claimed in claim 30 wherein said face sheet further defines a peel-out signature label portion, wherein said shipment form further comprises a peel-out release layer interposed between said peel-out signature label portion and said liner ply, wherein a portion of said laminating adhesive is interposed between said peel-out signature label portion and said peel-out release layer, and wherein said peel-out signature label portion, said laminating adhesive, and said peel-out release layer are configured such that said laminating adhesive retains its properties of adhesion and remains adhered to said peel-out signature label following removal of said peel-out signature label from said shipment form.

36. A shipment form as claimed in claim 30 wherein said liner ply and said reusable adhesive include respective cut-out portions formed therein to define a form hanging aperture.

37. A shipment form as claimed in claim 30 wherein said shipment form defines a top edge and a bottom edge and wherein said liner ply extends from said top edge to said bottom edge.

38. A shipment form as claimed in claim 36 further comprising a die cut extending entirely through a cross section of said form from a side edge of said form to said form hanging aperture.

* * * * *